United States Patent [19]

Rubbo

[11] Patent Number: 4,979,567

[45] **Date of Patent: * Dec. 25, 1990**

[54] METHOD AND APPARATUS FOR SELECTIVE RETRACTION OF A TUBING CARRIED PERFORATING GUN

[75] Inventor: Richard P. Rubbo, The Woodlands, Tex.

[73] Assignee: Baker Hughes Incorporated, Houston, Tex.

[ * ] Notice: The portion of the term of this patent subsequent to Aug. 21, 2007 has been disclaimed.

[21] Appl. No.: 345,107

[22] Filed: Apr. 28, 1989

[51] Int. Cl.[5] ..... E21B 43/11

[52] U.S. Cl. ..... 166/297; 166/55; 166/383

[58] Field of Search ..... 166/297, 381, 383, 55

[56] References Cited

U.S. PATENT DOCUMENTS 4,484,628 11/1984 Lanmon, II ..... 166/383 X 4,501,331 2/1985 Brieger ..... 166/297

*Primary Examiner*—William P. Neuder

*Attorney, Agent, or Firm*—Hubbard, Thurman, Turner & Tucker

[57] ABSTRACT

An apparatus and method are provided for telescopically retracting a subterranean well tubing carried perforating gun. The retracting apparatus comprises a cylindrical housing which is carryable into the well on a tubular conduit, such as a work string, production string, or the like. A first chamber is provided within the housing and contains a body of fluid. Telescoping piston means are selectively releasably locked relative to the housing. A second chamber is in selective fluid flow communication with the first chamber. Means in communication with the piston means are provided for carrying the perforating gun. Means for communicating well pressure to the piston means are actuated upon firing of the gun. Means are provided for transferring the body of fluid from the first chamber to the second chamber, whereby during such transferring, the perforating gun is telescopically retracted relative to the housing.

33 Claims, 5 Drawing Sheets

METHOD AND APPARATUS FOR SELECTIVE RETRACTION OF A TUBING CARRIED PERFORATING GUN

BACKGROUND OF THE INVENTION

1. FIELD OF THE INVENTION:

The invention relates to a method and apparatus for selective retraction of a tubing carried perforating gun within a subterranean well.

2. DESCRIPTION OF THE PRIOR ART:

Subsequent to the drilling of a subterranean oil or gas well, a string of tubular conduit commonly referred to as "casing" is run into ,the well. Thereafter, the casing is cemented into place. After the cementing operation, it is necessary to perforate the well so that production fluids within the production zone may flow from the production zone, through holes perforated through the cement behind the casing, into holes in the casing, and through the well bore to the top of the well.

For many years the desirability of utilizing a subterranean wellbore having a non-vertical or horizontal portion traversing a production formation has been known and appreciated in the prior art. Laterally directed bores are drilled radially, usually horizontally from the primary vertical wellbore, in order to increase contact with the production formation.

Most production formations have a substantial horizontal portions and, when conventional vertical wellbores are employed to tap such production formations, a large number of vertical bores must be employed. With the drilling of a wellbore having a non-vertical or horizontal portion traversing the production formation, a much greater area of the production formation may be traversed by the wellbore and the total field of drilling costs may be substantially decreased. Additionally, after a particular horizontal wellbore has produced all of the economically available hydrocarbons, the same vertical wellbore may be re-drilled to establish another horizontal portion extending in another direction and thus prolong the utility of the vertical portion of the well and increase the productivity of the well to include the total production formation.

By use of and reference to the phrase "wellbore" herein, it is intended to include both cased and uncased wells. When uncased wells are completed, the bore hole wall defines the maximum hole diameter at a given location. When cased wells are completed, the "wall" of the well will be the internal diameter of the casing conduit.

By use of the phrase "deviated well" and "deviated wellbore", it is meant to refer to wells and wellbores which comprise a vertical entry section communicating through a relatively short radius curvature portion with a non-vertical or horizontal portion communicating with the production formation. In most instances, the production formation extends for a substantial horizontal extent and the generally linear wellbore portion traverses a substantial horizontal extent of the production formation, at least up to a distance of 1000 to 2000 feet, or more. The radius portion of the wellbore has a curvature of at least 10° per 100 feet of length, and preferably a curvature lying in the range cf 10° to 30° per 100 feet of length.

The present invention is not limited to use in horizontal completions of deviated wells and can be used in conventional or straight hole subterranean wells. It does have particular utility in horizontal completions wherein it is desired to run into the well a perforating gun and thereafter treat or acidize a well all in one trip of the work string into and out of the well. When it is desired to perform such operations within a horizontal section of a deviated subterranean well, a completion hookup incorporating a tubing carried perforating gun in combination with the retraction apparatus of the present invention may be carried into the well on a work string carrying a retrievable packer and, somewhat below the retrievable packer, a permanent completion packer. The permanent completion packer has extending from its lowermost end a cylindrical production string having thereon a sliding sleeve mechanism for selectively opening and closing a port communicating to the annular area between the casing and the production string extending from below the permanent packer. The end of the production string is selectively sealingly latchable into a sump packer previously positioned just below the production zone. Through the interior of the production string and the permanent completion packer is carried by means of the retrievable packer a section of smaller concentrically positioned tubing having at its lowermost end the retraction apparatus of the present invention which, in turn, has affixed to its lowermost end the tubing carried perforating gun.

After activating the perforating gun, it is necessary to telescopically retract same with respect to the production string section extending from the lowermost end of the production packer so that the seal assembly surrounding the lowermost exterior of the production string may be latched into the sump packer. Thereafter, the production packer is set, the retrievable packer is unset and the apparatus is withdrawn from the well. The sliding sleeve is in the closed position, such that the production zone is thereby controllably isolated from the interior of the production string.

Of course, prior to engaging the seal assembly on the lowermost end of the production string into the sump packer any one of a number of selected treatment procedures may be effected, such as acidizing or fracturing of such zone, and such trreatment may be effected prior to setting of the permanent packer and withdrawal of the retrievable packer. Such a method and apparatus for use therein is disclosed in co-pending patent application Serial No. 345,347 filed on the same date as this application, entitled "METHOD AND APPARATUS FOR ONE TRIP HORIZONTAL COMPLETION" and assigned to the same assignee as this application.

SUMMARY OF THE INVENTION

The present invention provides an apparatus for telescopically retracting a subterranean well tubing carried perforating gun, and a method of use of said apparatus. The cylindrical housing is carryable into the well on a tubular conduit. A first chamber is provided within the housing and contains a body of fluid. A telescoping piston means is selectively releasably locked relative to the housing and a second chamber is provided which is in selective fluid flow communication with the first chamber. Means for carrying the perforating gun in association with the piston means are also provided such that the perforating gun and the piston means telescope relative to the housing. Means are provided for communicating well pressure to the piston means upon firing of the perforating gun and means for transferring the body of fluid from the first chamber to the second chamber are provided whereby during the transferring, the gun is telescopically retracted relative to the housing.

DESCRIPTION OF THE PREFERRED EMBODIMENTS

Figure 1:
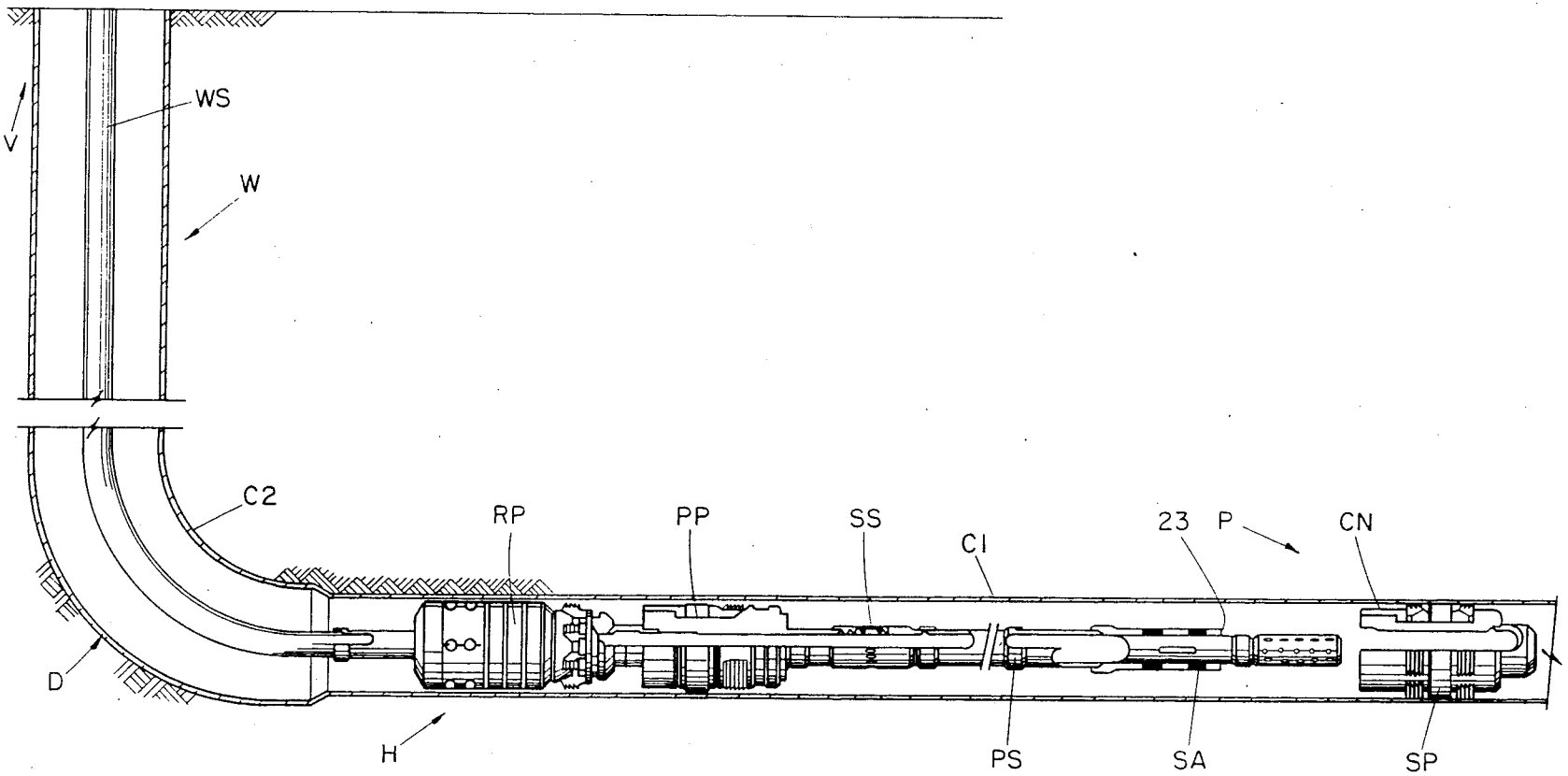
FIG. 1 is a schematic illustration of a subterranean well incorporating the apparatus of the present invention on a work string in a horizontal section of a deviated well.
Figure 2A:
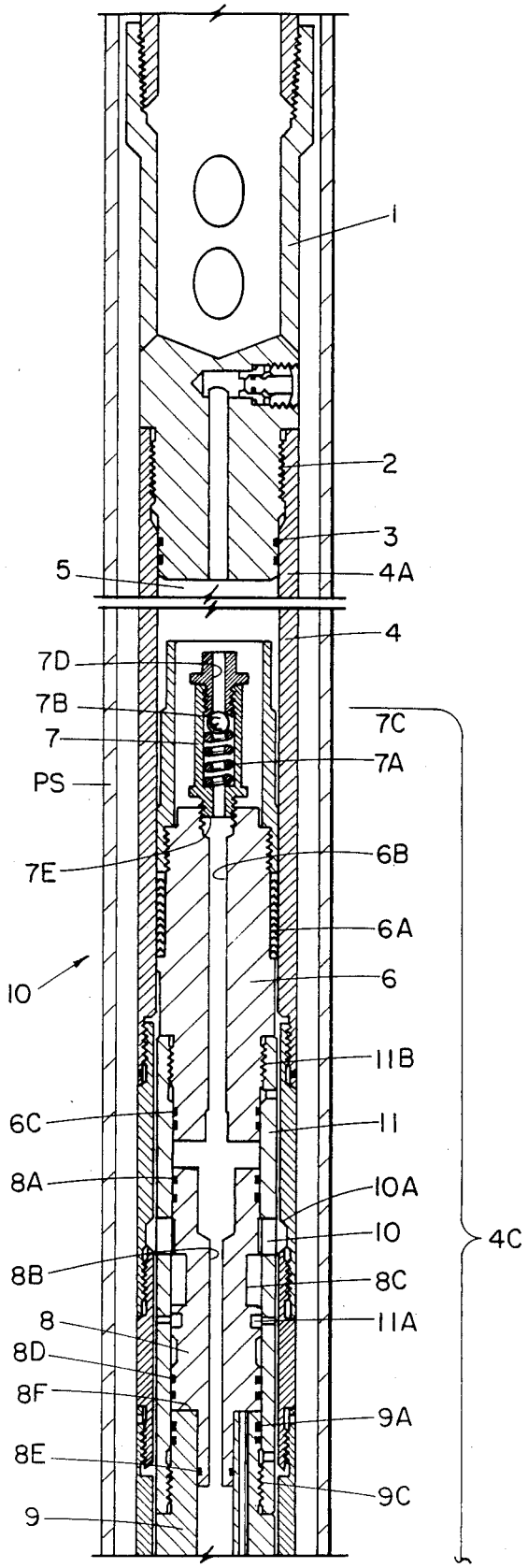
FIGS. 2A through 2D together constitute a longitudinal sectional illustration of the apparatus of the present invention with the component parts in position.
Figure 2B:
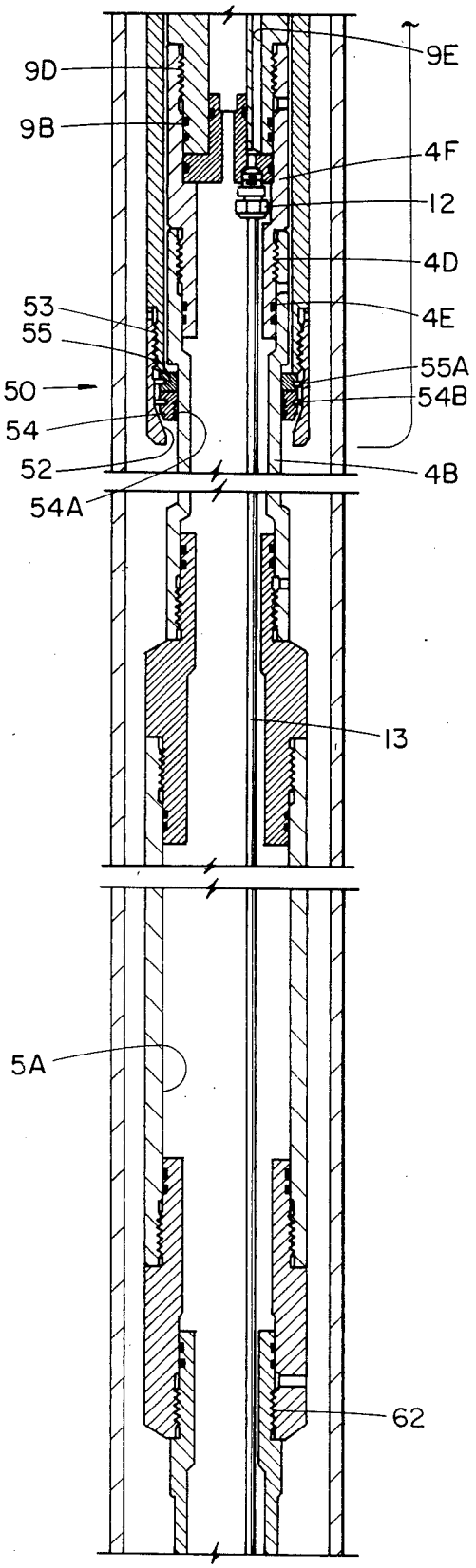
Figure 2C:
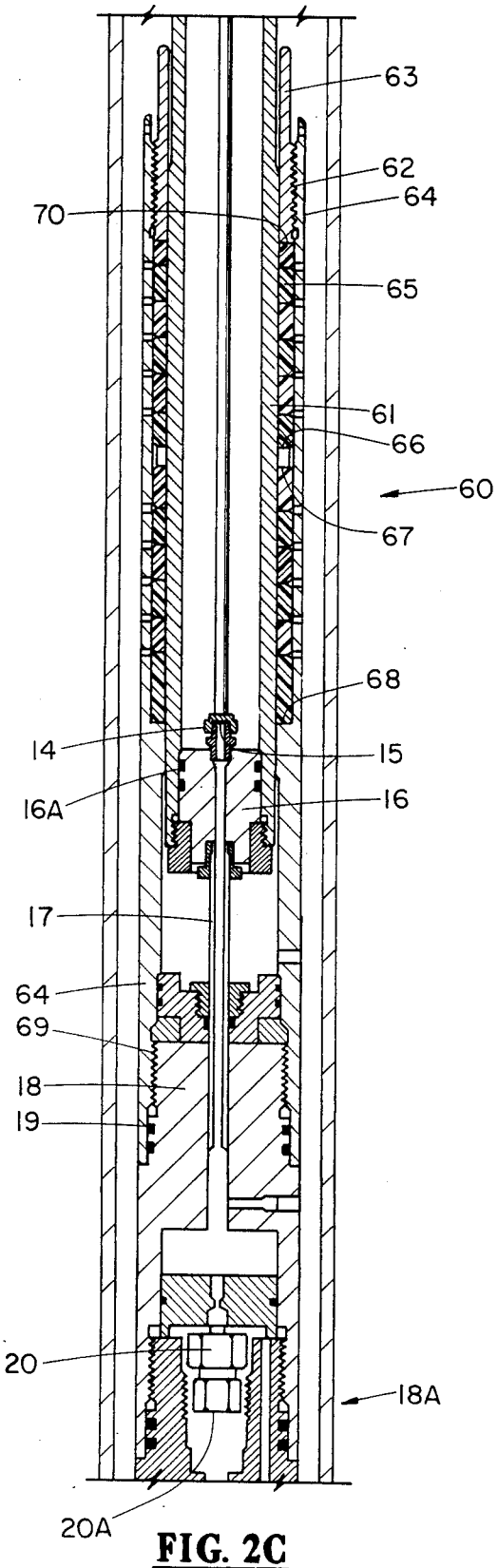
Figure 2D:
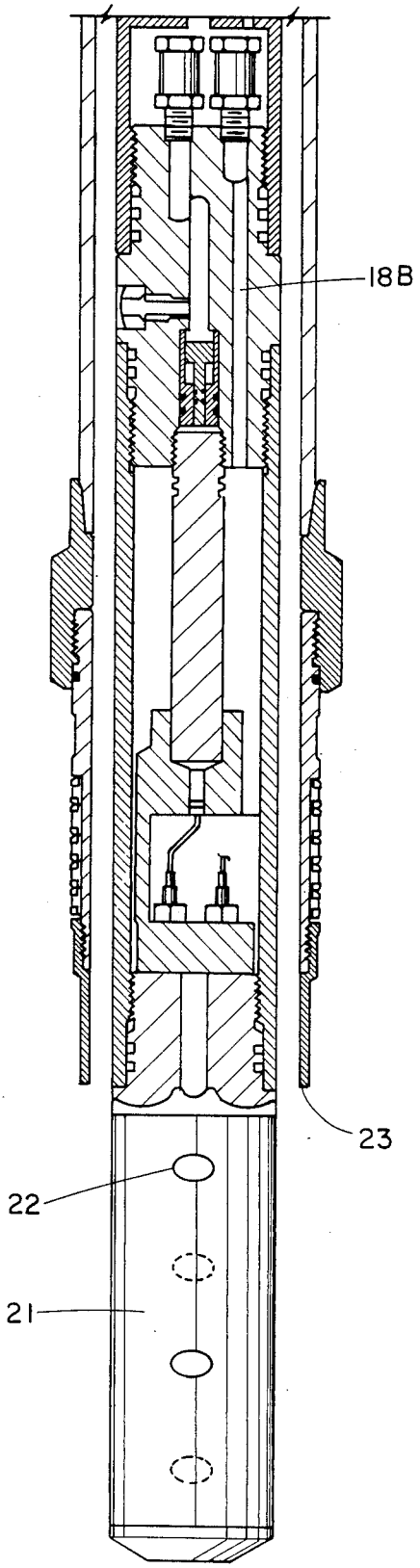
Figure 3A:
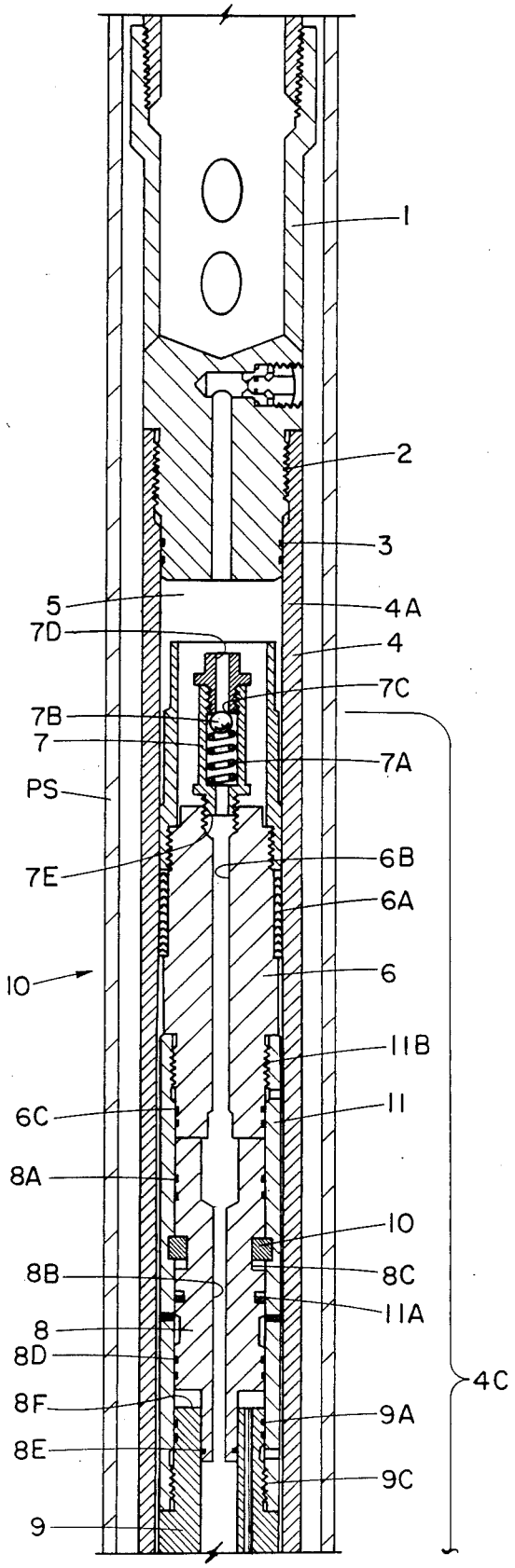
FIGS. 3A through 3D constitute a longitudinal sectional illustration similar to that of FIGS. 2A through 2D showing the apparatus of the present invention in telescopically retracted position subsequent to the firing of the perforating gun.
Figure 3B:
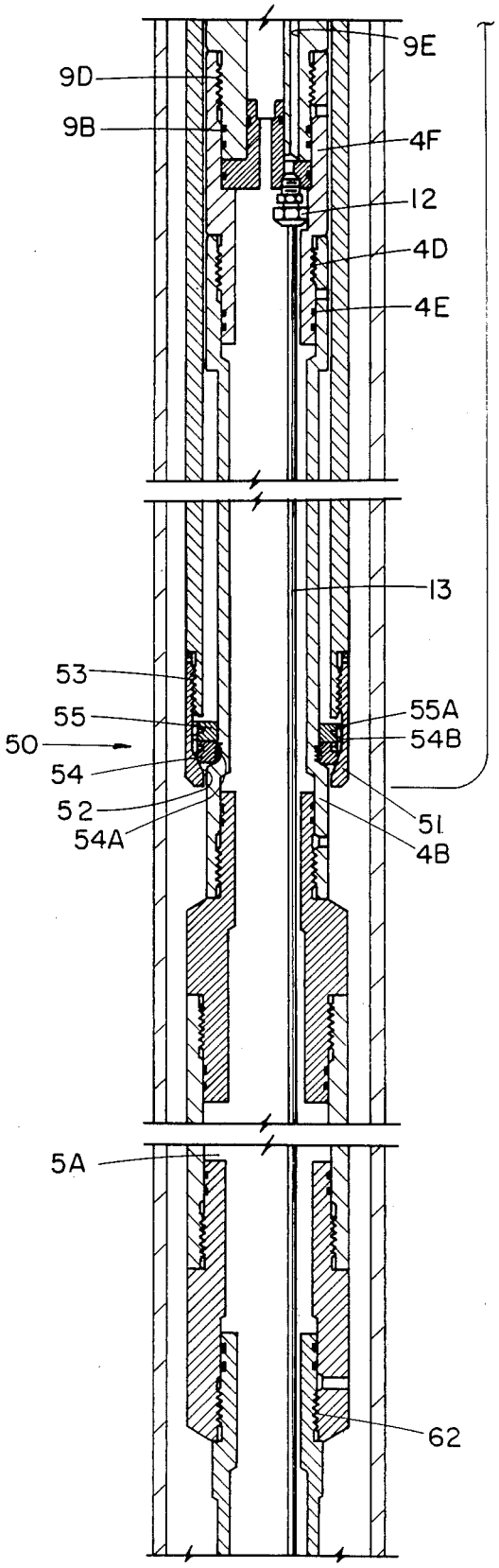
Figure 3C:
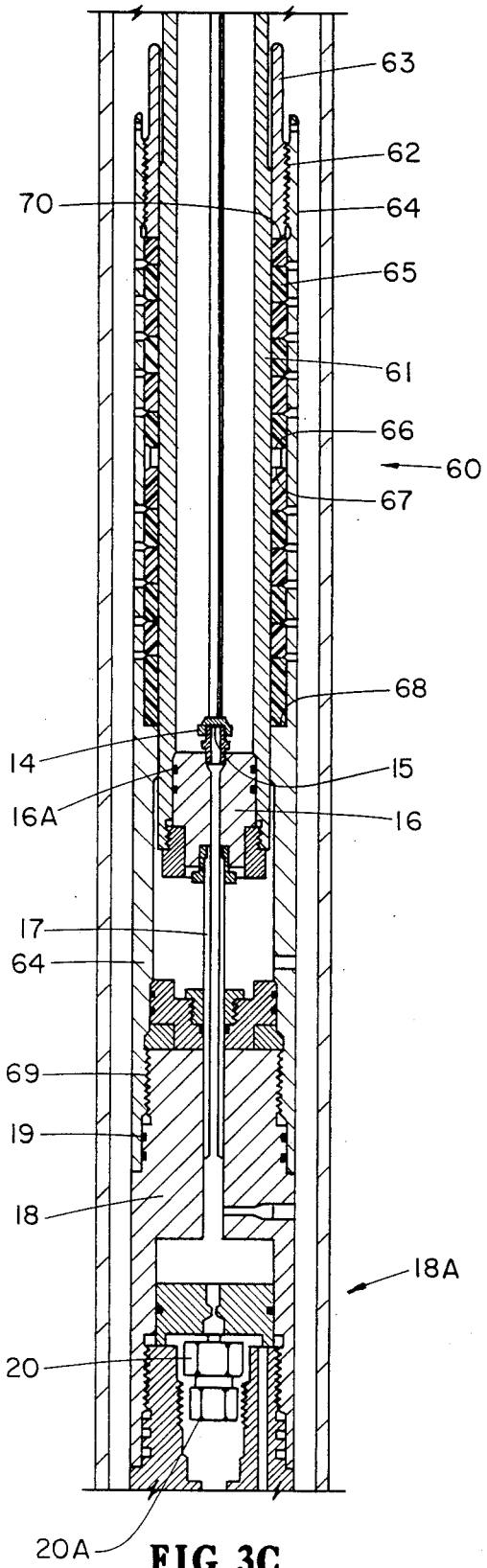
Figure 3D:
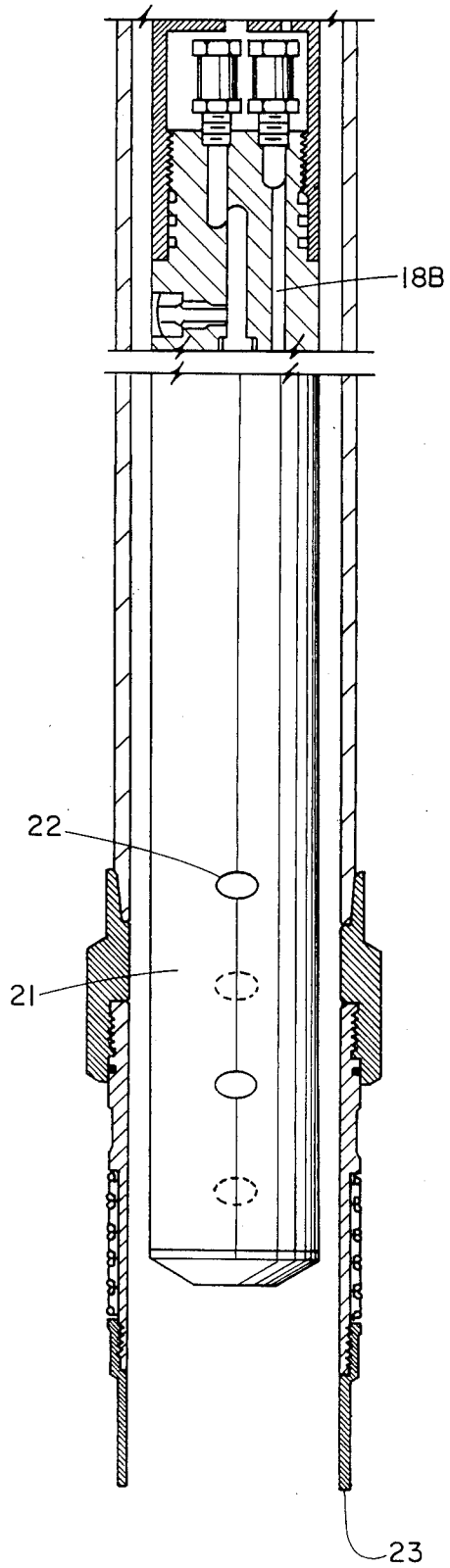

With reference to FIG. 1, there is shown a subterranean well W having a first vertical section V communicating with the top of the well and extending into a deviation or curvature thereof D which, in turn, extends into a horizontal section H traversing a production zone P.

Prior to running the apparatus 10 into the well on a work string WS also carrying a retrievable packer RP and a permanent packer PP, the casing C has been placed into the well and cemented therein. The casing C will have perforations therethrough subsequent to the firing of the perforating gun 21.

A section of production string PS extends from and is carried on work string WS below the permanent packer PP with a seal assembly SA circumferentially extending around the exterior of the section of production string PS approximate the end 23 thereof for selective stabbing within the interior of a connector CN extending upwardly from a sump packer SP positioned and set within the well W below the production zone P. A sliding sleeve mechanism SS is provided on the production string PS and is placed initially in the open position to permit communication between the production string-casing annulus and the interior of the production string PS.

Now referring to FIGS. 2A through 2D, the apparatus 10 is comprised of an upper housing member 4*a* and a lower housing member 4*b* telescopically extending therefrom and secured thereto by means of a piston and a locking assembly 4*c*. The apparatus 10 is shown telescopically extended through the production string PS and has a housing 4 comprising an upper housing member 4*a* and a lower housing member 4*b*. The upper housing member 4*a* is secured by means of threads 2 to the work string or tubular conduit 1 with a series of circumferentially extending elastomeric O-ring seal elements 3 disposed between the upper housing member 4*a* and a solid connection portion of the tubular conduit 1. The upper housing member 4*a* is cylindrical and within its interior is the first chamber 5 which is filled with a body of fluid, such as clean water, at the top of the well before the apparatus 10 is introduced within the well W.

The upper housing member 4*a* joins the lower housing member 4*b* telescopically extending through the lowermost end thereof with a piston and locking assembly disposed between the housing members 4*a*, 4*b*, as discussed, below.

Within the piston and locking assembly 4*c* is a piston 6 slidably carried along the smooth interior wall of the upper housing member 4*a*, a seal assembly 6*a* carried around the the exterior of the piston 6 preventing fluid transmission across the piston 6 and the upper housing member 4*a*. The piston 6 has a central flow passageway 6*b* extending therethrough and terminating at the lower end 7*e* of a pressure relief valve assembly 7 which, in turn, has an upper opening 7*d* directly communicating with in the interior of the first chamber 5 thereabove. The pressure relief valve 7 has a biasing spring member A extending to a head member 7*b* selectively sealingly engagable relative to a seat member 7*c* therefore.

The pressure relief valve 7 is a one way acting valve, that is, the spring 7*a* biases the head 7*b* towards the seat 7*c* such that fluid within the first chamber 5 is prevented from passing from within the chamber 5 and lowerly through the flow passageway 6*b* until such time as a pre-determined pressure is exceeded, said pre-determined pressure being t e biasing rating of the spring 7*a* in the opposite direction.

The piston 6 provides at its lowermost end a series of circumferentially extending elastomer seals 6*c* to prevent fluid communication between the piston 6 and a lock dog housing 11 secured thereto by means of threads 11*b*.

The lock dog housing 11 also carries a free piston 8 selectively movable within the interior of the piston and locking assembly 4*c* and carried in spaced relation below the piston 6 and above a piston connector 9. The free piston 8 has a fluid passageway 8*b* in companion communication with the flow passageway 6*b* of the upper piston 6. Elastomer seals 8*a* are provided at the uppermost end of the free piston 8 to prevent fluid communication between the free piston 8 and the lock dog housing 11. A similar series of seals 8*d* is disposed around the lower exterior of the free piston 8 to also prevent fluid communication between the piston 8 and the lock dog housing 11. Similarly, seals 8*e* extend from a nose portion of the free piston 8 and into the smooth interior wall of the piston connector 9 therebelow to prevent fluid communication between the connector 9 and the free piston 8.

A release groove 8*c* is defined around the exterior of the free piston 8, the groove 8*c* having a diameter somewhat smaller than the balance of the diameter of the free piston 8 for selective receipt of locking dogs 10 which are caused during the telescoping action, described below, to be snapped into contracted position into the release groove 8*c* to permit the free piston 8 to travel upwardly to permit communication between the passageway 8*b* within the free piston 8 and flow passageway 9*e* carried through the interior of the piston connector 9. The free piston 8 is secured to the lock dog housing 11, initially, by means of a shear pin 11*a*.

The housing 4 has a running groove 10*a* for initial receipt of the locking dogs 10, such that when the dogs 10 are in the running groove 10*a* longitudinal movement of the free piston 8 relative to the upper housing member 4*a* is prevented.

The piston connector 9 is secured at threads 9*c* to the lock dog housing 11 and has a series of upper elastomeric seal members 9*a* placed circumferentially around its uppermost exterior to prevent fluid communication with the lock dog housing 11 thereabove. A similar series of seals 9*b* extend around the lower exterior of the piston connector 9 to prevent fluid communication between the connector 9 and an extension 4*c* of the lower housing member 4b. The extension 4c is secured at threads 4d to the lower housing member 4b and seals 4e prevent fluid communication between the extension 4c and the lower housing member 4b. The extension 4c is secured at threads 9d to the connector piston 9. The piston connector 9 is, in turn, secured by threads 9c to the lock dog housing 11. The connector 9 has a hollow interior through which extends a bored flow passageway 9e. Initially, fluid flow through the passageway 9e is prevented from passing within the passageway 8b of the free piston 8 by means of the seals 8d, 8e. However, as described below, when the free piston 8 is shearably released from the lock dog housing 11, the passageways 9e, 8b are permitted to fluidly communicate with one another for transmission of well pressure, as described below.

The free piston 8 has an end 8f which rests upon the upper most face of the piston connector 9 when the free piston 8 is engaged to the lock dog housing 11 by the shear pin 11a.

The flow passageway 9e extends lowerly into a connector 12 which secures the uppermost end of a well pressure tube 13 which extends completely through the lower housing member 4b therebelow and interiorly of a second chamber 5a within the lower housing member 4b and threadably terminating into engagement with a lower connector 14. The connector 14 houses a rupture disc 15 which prevents fluid transmission through the connector 14 and the tube 13 extending therethrough with the disc 15 rupturing at a pre-determined pressure as well pressure is defined thereacross subsequent to the firing of the gun 21. Typically such discs 15 will shear at approximately 1000 psi, but such shear rating is, of course, entirely selective.

The connector 14 is threadably engaged within an adaptor 16 which defines the terminal end of an inner housing 61 of a shock absorber assembly 60 secured at threads 62 to the lower housing member 4b with the interior of the inner housing 61 being a lower extension of the housing 4b. The adaptor 16 has a series of seals 16a at its uppermost end to prevent fluid communication between the adaptor 16 and the inner housing 61.

A tubing extension 17 is sealingly and threadably secured into the lowermost end of the adaptor 16 for fluid communication with the connector 14 and the well pressure tube 13. The tubing extension 17 has its lower end open and facing within the firing head housing 18 secured at threads 69 to the outer housing 64 of the shock absorber assembly 60 thereabove with seals 19 disposed around the exterior of the firing head housing 18 to prevent fluid communication between the housing 18 and the housing 64.

The tubing extension 17 extends into engagement with a well tubing connector 20 having an opening 20a at its lowermost end extending within the firing head housing 18 of the firing head assembly 18a and communicating through a generally defined well flow passage 18b through the firing head assembly 18a which, in turn, communicates to the well exterior of the end 23 of the production string PS and interior of the casing C to pressure in the well transmitted through the perforations after the gun 21 has been fired, with such pressure extending through the gun 21 through the open shot holes 22.

The production string PS has a seal assembly SA extending at its lowermost end which is selectively sealingly stabbable into a connector CN extending upwardly from the sump packer SP, subsequent to retraction of the gun 21, described below.

Within the lower housing member 4b is the second chamber 5a which, initially, contains only air, or other gaseous substance, at atospheric pressure, and is selectively communicable with the first chamber 5 by means of the passageway 8b through the free piston 8 and the flow passageway 6b through the piston 6 such that as telescopic movement between the upper housing member 4a and the lower housing member 4b is effected, the fluid within the first chamber 5 is permitted to be transferred into the lower housing member 4b during such telescopic motion.

The piston and locking assembly 4c includes locking means 50 comprising a lock nose 51 carried by means of threads 53 on the lowermost end of the upper housing member 4a. The lock nose 51 has a beveled profiled inner surface 52 having a lowerly extending contracting inner diameter to urge a slip member 54 circumferentially carried interiorly of the lock nose 51 interiorly toward the outer exterior of the lower housing member 4b in the event that the member 4b is urged into expanding direction during or subsequent to the telescopic action, described below. The slip 54 also has a series of circumferentially subscribed serrated teeth members 54a on its interior for gripping into the lower housing member 4b to prevent such telescopic expanding movement of the member 4b relative to the member 4a. A ring member 54b is carried around the exterior of the slip assembly 54 to urge same toward the housing member 4b as the slip 54 moves downwardly and is interiorly contracted by means of the profile 52 on the lock nose 51.

A lock dog 55 is also housed within a lock nose 51 and has a companion garter ring 55a therearound to urge the dog 55 into contracting relationship relative to the member 4b.

If the lower housing member 4b is urged in expanding direction during or after telescopic interaction, the lock dog 55 will act on the slip 54 to urge it against the lock nose 51 such that the profile 52 will cause the slip 54 and, correspondingly, the teeth 54a into further gripping engagement with the lower housing member 4b to lock the member 4b in the telescopically contracted position.

The apparatus 10 also provides a shock absorber system 60 (FIG. 2C) to prevent shock incurred as a result of the firing of the gun 21 from being delivered through the tubular members, such as the lower housing member 4b, etc. The shock absorber 60 has an inner housing 61 which is also the lowermost portion of the second chamber 5a and is secured to the central lower housing member 4b by means of threads 62. A top sub member 63 is carried exteriorly around the inner housing 61 and is secured at threads 62 to an outer housing 64 with a series of elastomeric rubber rings 65 in stacked relationship between the outer housing 64 and the inner housing member 61. A series of resistance shoulders 66, 67, 68 and 70 are provided for impact load transfer to threads 69 securing the firing head housing 18 to the outer housing 64. Any upward loading transmitted through the firing head housing 18 to the outer housing 64 will be absorbed by the elastomer rings 65 and upon the shoulders 67, 70, with downward load being carried through the shoulder 68, 66.

OPERATION

The apparatus 10 of the present invention carries the gun 21 and the firing head assembly 18 secured therebelow. When the apparatus 10 is run into the well, the gun 21 and firing head assembly 18 are placed in telescopically extending position and are secured directly to the lower housing member 4b which is secured to the upper housing member 4a in expanded position by means of the interengagement of the locking dogs 10 in the running groove 10a and the shearably secured free piston 8 with the shear pin 11a in engagement to the lock dog housing 11.

Prior to running of the apparatus 10 into the well W, the lower housing member 4b will contain a gas, such as air, at atomspheric pressure. The first chamber 5 will be filled with water, or other liquid, also at atompsheric pressure. The apparatus 10 now may be run into the well W and positioned adjacent the production zone P and carried into the well on a packer, such as the retrievable packer RP carried into the well on a work string WS. The production string PS also may be carried into the well on the retrievable packer RP and is hung from the lowermost end of the permanent packer PP also carried into the well and extending from the retrievable packer RP. The retrievable packer RP is first set, and the gun 21 is actuated, in known fashion, to cause perforations to be placed through the casing C and the production zone P. Now, increased well pressure will come within the bore interior of the casing C, through the open shot holes 22 in the gun 21 and will be transmitted through the well flow passage 18b in the firing head assembly 18a and into the open end 20a of the tubing connector 20. Such increased well pressure will be immediately transmitted through the tubing extension 17 and the rupture disc 15 will be ruptured, with such well pressure now being conveyed through the well pressure tube 13 and into the flow passageway 9e of the piston connector 9. As the well pressure increases, such pressure will be defined across the piston end 8d of the free piston 8 and the shear pin 11a will be sheared. The free piston 8 now will move into abutting engagement with the lower end of the piston 6. As the free piston 8 moves upwardly, the release groove 8c will move upwardly until it is parallel with the locking dogs 10 within the running groove 10a. The locking dogs 10 now will contract and be received within the release groove 8c. Now, the lower housing member 4b no longer is secured against longitudinal movement relative to the upper housing member 4a, and telescopic contracting movement between such housing members 4a, 4b is initiated. As such movement is initiated, the piston 6, free piston 8, and lower housing member 4b will telescopically contract relative to the upper housing member 4a. Such telescoping contraction will increase the pressure within the first chamber 5 until such time as the bias within spring 7a holding the valve head 7b on the seat 7c is overcome and the head 7b will be biased away from the seat 7c to permit the fluid within the first chamber 5 to be transmitted through the pressure relief valve 7, and into the flow passageway 6b of the piston 6, thence through the passageway 8b of the free piston 8 and into the lower second chamber 5a. Thus, the telescopic contraction is dampened by the metering of the fluid within the first chamber 5 through the pressure relief valve 7 and into the second chamber 5a.

When the telescopic action between the upper housing member 4a and lower housing member 4b has been effected, the lower housing member 4b will be prevented from telescopically expanding relative to the upper housing member 4a by means of the interengagement of the teeth 54a of the slip 54 onto the smooth exterior of the lower housing member 4b as the lock dog members 55 urge the slip 54 downwardly and into contracting position relative to the profile 52 on the lock nose 51.

Subsequent to the telescopic action, it will be appreciated that the lowermost end of the gun 21 is within the end 23 of the section of the production string PS and the seal assembly SA now may be stabbed into the upwardly extending connector CN and into the bore of the sump packer SP. Alternatively, prior to such stabbing action of the seal assembly SA, acidizing or fracturing of the well can be established in a known manner.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. Apparatus for telescopically retracting a subterranean well tubing carried perforating gun, comprising:

(1) a cylindrical housing carryable into said well on a tubular conduit;

(2) a first chamber within said housing and containing a body of fluid;

(3) telescoping piston means selectively releasably locked relative to said housing;

(4) a second chamber in selective fluid flow communication with said first chamber;

(5) means securing the perforating gun relative to said piston means;

(6) means for communicating well pressure to said piston means upon firing of said perforating gun; and (7) means for selectively transferring said body of fluid from said first chamber to said second chamber, whereby during such transferring, said gun is telescopically retracted relative to said housing.

2. The apparatus of claim 1 wherein said body of fluid in said first chamber is a liquid at atmospheric pressure.

3. The apparatus of claim 1 wherein said second chamber initially contains a gas selectively displaceable by said body of fluid upon telescopic movement of said piston means.

4. The apparatus of claim 1 wherein said means for transferring said body of fluid comprises fluid metering means.

5. The apparatus of claim 1 wherein said means for transferring said body of fluid comprises one way check valve means.

6. The apparatus of claim 1 further comprising means for locking said gun in the telescopically retracted position.

7. The apparatus of claim 6 wherein said means for locking said gun in the telescopically retracted position comprises wicker means carryable between said housing and said means for securing the perforating gun relative to said piston means and movable into radial contraction relative to said means for securing the perforating gun relative to said piston means by telescopic expanding urging between said housing and said means for securing the perforating gun relative to said piston means subsequent to said piston means being moved in telescopically retracted direction.

8. The apparatus of claim 1 further comprising means for selectively locking said piston means and said housing in the telescopically expanded position.

9. The apparatus of claim 8 wherein said means for selectively locking said piston means comprises expanded locking dogs radially movable into contracted position within said piston means upon pre-determinable increase of said well pressure.

10. The apparatus cf claim 1 further comprising means for absorbing impact shock to said apparatus resulting from explosion of said perforating gun.

11. The apparatus cf claim 10 wherein said means for absorbing impact shock to said apparatus comprises a series of elastomeric elements circumferentially carried exteriorly of said means in communication with said piston means and responsive to expanding and contracting shock movements through said gun upon firing of said gun within said well.

12. Method for telescopically retracting a subterranean well tubing carried perforating gun, comprising:

(a) assembling at the top of the well a tubular conduit string having thereon a tubing carried perforating gun and a perforating gun retracting apparatus, said gun retracting apparatus comprising:
  (1) a cylindrical housing carried into said well on said tubular conduit;
  (2) a first chamber within said housing and containing a body of fluid;
  (3) telescoping piston means selectively releasably locked relative to said housing;
  (4) a second chamber in selective fluid flow communication with said first chamber;
  (5) means securing the perforating gun relative to said piston means;
  (6) means for communicating well pressure to said piston means upon firing of said perforating gun; and
  (7) means for selectively transferring said body of fluid from said first chamber to said second chamber, whereby during each transferring, said gun is telescopically retracted relative to said housing;

(b) running said perforating gun and said retracting apparatus on said tubular conduit into said well;

(c) positioning said gun adjacent a production zone; and (d) actuating said perforating gun to fire same, whereby upon firing of said perforating gun, well pressure is communicated to said piston means and said body of fluid is transferred from said first chamber to said second chamber and said piston means and said gun are telescopically retracted relative to said housing.

13. The method of claim 12 wherein said body of fluid in said first chamber is a liquid at atmospheric pressure.

14. The method of claim 12 wherein said second chamber initially contains a gas selectively displaceable by said body of fluid upon telescopic movement of said piston means.

15. The method of claim 12 wherein said means for transferring said body of fluid comprises fluid metering means.

16. The method of claim 12 wherein said means for transferring said body of fluid comprises one way check valve means.

17. The method of claim 12 further comprising means for locking said gun in the telescopically retracted position.

18. The method of claim 17 wherein said means for locking said gun in the telescopically retracted position comprises wicker means carryable between said housing and said means for securing the perforating gun relative to said piston means and movable into radial contraction relative to said means for securing the perforating gun relative to said piston means by telescopic expanding urging between said housing and said means for securing the perforating gun relative to said piston means subsequent to said piston means being moved in telescopically retracted direction.

19. The method of claim 12 further comprising means for selectively locking said piston means and said housing in the telescopically expanded position.

20. The method of claim 19 wherein said means for selectively locking said piston means comprises expanded locking dogs radially movable into contracted position within said piston means upon pre-determinable increase of said well pressure.

21. The method of claim 12 further comprising means for absorbing impact shock to said apparatus resulting from explosion of said perforating gun.

22. The method of claim 21 wherein said means for absorbing impact shock to said apparatus comprises a series of elastomeric elements circumferentially carried exteriorly of said means in communication with said piston means and responsive to expanding and contracting shock movements through said gun upon firing of said gun within said well.

23. Apparatus for use in the completion of a subterranean well, comprising:

(1) a tubing carried perforating gun;
(2) a cylindrical housing carryable into said well on a tubular conduit;
(3) a first chamber within said housing and containing a body of fluid;
(4) telescoping piston means selectively releasably locked relative to said housing;
(5) a second chamber in selective fluid flow communication with said first chamber;
(6) means securing the perforating gun relative to said piston means;
(7) means for communicating well pressure to said piston means upon firing of said perforating gun; and
(8) means for selectively transferring said body of fluid from said first chamber to said second chamber, whereby during such transferring, said gun is telescopically retracted relative to said housing.

24. The apparatus of claim 23 wherein said body of fluid in said first chamber is a liquid at atmospheric pressure.

25. The apparatus of claim 23 wherein said second chamber initially contains a gas selectively displaceable by said body of fluid upon telescopic movement of said piston means.

26. The apparatus of claim 23 wherein said means for transferring said body of fluid comprises fluid metering means.

27. The apparatus of claim 23 wherein said means for transferring said body of fluid comprises one way check valve means.

28. The apparatus of claim 23 further comprising means for locking said gun in the telescopically retracted position.

29. The apparatus of claim 28 wherein said means for locking said gun in the telescopically retracted position comprises wicker means carryable between said housing and said means for securing the perforating gun relative to said piston means and movable into radial contraction relative to said means for securing the perforating gun relative to said piston means by telescopic expanding urging between said housing and said means for securing the perforating gun relative to said piston means subsequent to said piston means being moved in telescopically retracted direction.

30. The apparatus of claim 23 further comprising means for selectively locking said piston means and said housing in the telescopically expanded position.

31. The apparatus cf claim 30 wherein said means for selectively locking said piston means comprises expanded locking dogs radially movable into contracted position within said piston means upon pre-determinable increase of said well pressure.

32. The apparatus cf claim 23 further comprising means for absorbing impact shock to said apparatus resulting from explosion of said perforating gun.

33. The apparatus cf claim 32 wherein said means for absorbing impact shock to said apparatus comprises a series of elastomeric elements circumferentially carried exteriorly of said means in communication with said piston means and responsive to expanding and contracting shock movements through said gun upon firing of said gun within said well.

* * * * *